US010243301B2

(12) United States Patent
Bernard et al.

(10) Patent No.: US 10,243,301 B2
(45) Date of Patent: Mar. 26, 2019

(54) BLIND MATE CONNECTOR HOUSING AND ASSEMBLY

(71) Applicant: Raytheon Company, Waltham, MA (US)

(72) Inventors: Robert P. Bernard, McKinney, TX (US); James A. Pruett, Allen, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/459,295

(22) Filed: Mar. 15, 2017

(65) Prior Publication Data

US 2018/0269629 A1 Sep. 20, 2018

(51) Int. Cl.
*H01R 13/631* (2006.01)
*H01R 13/518* (2006.01)
(Continued)

(52) U.S. Cl.
CPC ..... *H01R 13/6315* (2013.01); *H01R 4/48* (2013.01); *H01R 12/91* (2013.01); *H01R 13/518* (2013.01); *H01R 24/40* (2013.01); *H01R 9/05* (2013.01); *H01R 9/0515* (2013.01); *H01R 13/28* (2013.01); *H01R 13/567* (2013.01);
(Continued)

(58) Field of Classification Search
CPC ..... H01R 24/50; H01R 13/28; H01R 13/518; H01R 13/659; H01R 24/38; H01R 9/05; H01R 24/545; H01R 13/567; Y10S 439/902
USPC ..... 439/63, 248, 540.1, 582, 854, 855, 902, 439/731, 687, 906, 881, 694, 247
See application file for complete search history.

(56) References Cited

U.S. PATENT DOCUMENTS 4,892,491 A * 1/1990 Budano, II ..... H01R 24/44 439/578
5,676,569 A * 10/1997 Davis ..... H01R 13/518 439/540.1
(Continued)

FOREIGN PATENT DOCUMENTS

CN 201438524 4/2010
CN 203589316 5/2017
(Continued)

OTHER PUBLICATIONS

International Search Report for International Application No. PCT/US2018/013613 dated May 16, 2018, 14 pages.

*Primary Examiner* — Abdullah A Riyami
*Assistant Examiner* — Justin M Kratt

(57) ABSTRACT

A blind mate connector assembly comprises a first manifold and a second manifold removably coupled to the first manifold that defines a connector housing positionable between a primary electronics assembly and a secondary electronics assembly. A plurality of connector cavities are defined between the first and second manifolds. A plurality of right angle cable connectors, each situated within one of the plurality of connector cavities, extend partially through the connector housing to facilitate blind mate connection between the primary electronics assembly and the secondary electronics assembly. The connector housing comprises at least one mechanical float mechanism configured to facilitate movement of each right angle cable connector in multiple degrees of freedom. The connectors are replaceable by disassembling the first and second manifolds.

21 Claims, 3 Drawing Sheets

(51) Int. Cl.

| | |
|---|---|
| ***H01R 4/48*** | (2006.01) |
| ***H01R 24/40*** | (2011.01) |
| ***H01R 12/91*** | (2011.01) |
| *H01R 13/28* | (2006.01) |
| *H01R 13/659* | (2011.01) |
| *H01R 24/54* | (2011.01) |
| *H01R 24/38* | (2011.01) |
| *H01R 13/56* | (2006.01) |
| *H01R 24/50* | (2011.01) |
| *H01R 9/05* | (2006.01) |

(52) U.S. Cl.
CPC ..... *H01R 13/659* (2013.01); *H01R 24/38* (2013.01); *H01R 24/50* (2013.01); *H01R 24/545* (2013.01); *Y10S 439/902* (2013.01)

(56) References Cited

U.S. PATENT DOCUMENTS

| | | | | |
|---|---|---|---|---|
| 6,700,464 | B2 | 3/2004 | Ling et al. | |
| 7,118,383 | B2 | 10/2006 | Nagata et al. | |
| 8,002,574 | B1 | 8/2011 | Yi | |
| 8,137,134 | B1 * | 3/2012 | Chang ..... | H01R 9/0518 439/582 |
| 2006/0084286 | A1 | 4/2006 | Kooiman | |

FOREIGN PATENT DOCUMENTS

| | | | | |
|---|---|---|---|---|
| EP | 2208259 | A1 | 7/2010 | |
| EP | 3043425 | A1 * | 7/2016 | ..... H01R 13/6315 |
| EP | 3043425 | A1 * | 7/2016 | ..... H01R 13/6315 |

* cited by examiner

BLIND MATE CONNECTOR HOUSING AND ASSEMBLY

GOVERNMENT LICENSE RIGHTS

This invention was made with government support under contract H94003-04-D-0006-0328 awarded by The Department of Defense. The government has certain rights in the invention.

BACKGROUND

A particular electronic assembly may have a number of electrical connectors that electrically (and mechanically) couple to another electronic assembly or system. Often, area/space on or around these electronics assemblies is limited and valuable. Thus, low-profile electrical and mechanical connections between such assemblies is desired, such as with RF connectors. Moreover, as such connectors become damaged or need to be updated and replaced, it can be cumbersome, time consuming, and costly to replace such connectors. Finally, tolerance issues can cause misalignment between a pair of electronic assemblies, which can pose various problems when electrically and mechanically coupling the assemblies together.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
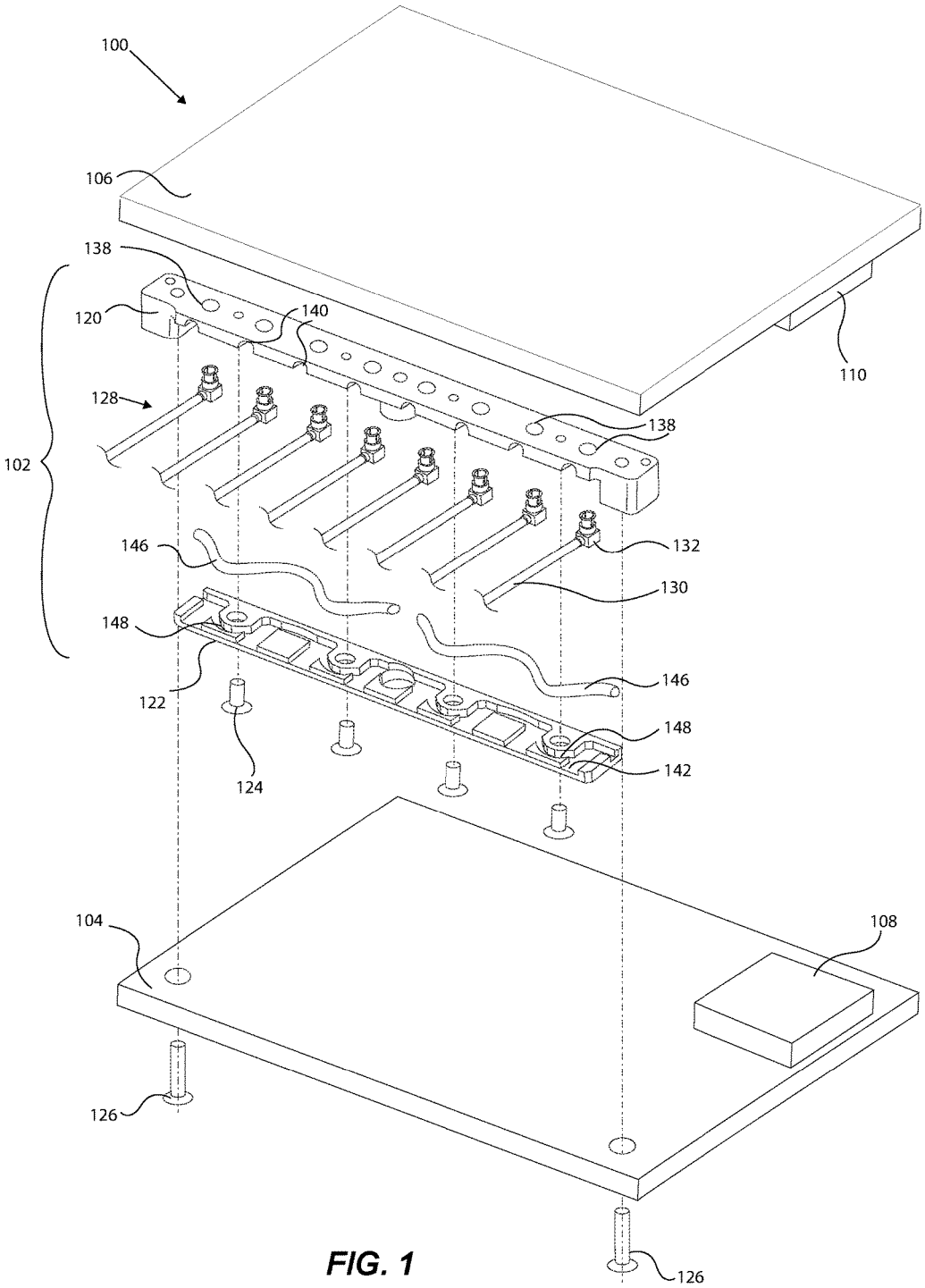
FIG. 1 is an exploded isometric view of a blind mate connector assembly positioned between a pair of electronic assemblies according to one example of the present disclosure.
Figure 2:
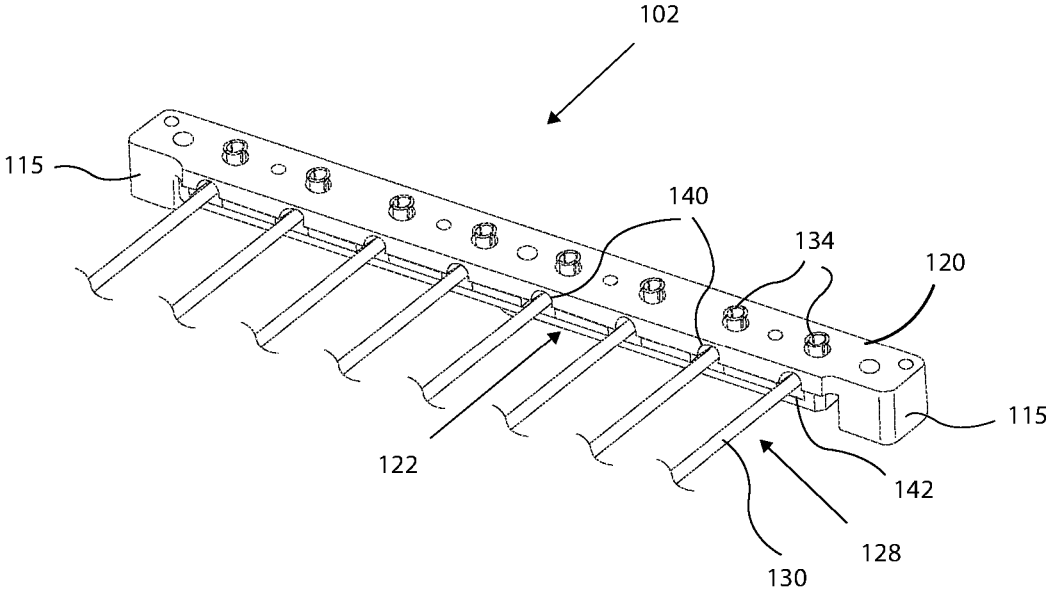
FIG. 2 is an assembled isometric view of the blind mate connector assembly of FIG. 1.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

In one example, there is disclosed herein a cable connector housing for blind mate connection of a right angle cable connector to an electronics assembly. The cable connector housing comprises a housing body and a connector cavity formed within the housing body and configured to receive and retain a right angle cable connector. A first opening is formed through the housing body and extends to the connector cavity and has a central axis and is sized to receive a blind mate connecting portion of the right angle cable connector. A second opening is formed through the housing body and extends to the connector cavity. The second opening has a central axis and is sized to receive a cable line connected to the right angle cable connector. The central axes of the first and second openings are oriented orthogonal to one another. In one aspect, the cable connector housing comprises a mechanical float mechanism configured to facilitate movement of the right angle cable connector relative to the connector cavity and the housing body in multiple degrees of freedom.

In another example there is disclosed herein a blind mate connector assembly comprising a first manifold comprising a plurality of first openings each having a central axis, and a second manifold removably coupled to the first manifold to define a connector housing positionable between a primary electronics assembly and a secondary electronics assembly. The second manifold comprises a plurality of second openings each having a central axis. A plurality of connector cavities defined by the first and second manifolds. A plurality of right angle cable connectors, each situated within one of the plurality of connector cavities, and the right angle cable connectors facilitate blind mate connection between the primary electronics assembly and the secondary electronics assembly. In one aspect, the connector housing comprises a mechanical float mechanism configured to facilitate movement of the right angle cable connector relative to the connector cavity and the housing body in multiple degrees of freedom.

In another example there is disclosed herein an electronics system comprising a primary electronics assembly and a secondary electronics assembly mechanically and electrically coupled to each other. A blind mate connector assembly coupled between the primary electronics assembly and the secondary electronics assembly comprises a housing removably attached to the primary electronics assembly. The housing has a plurality of connector cavities. A plurality of cables each comprises a cable connector and a cable line extending from the cable connector. Each cable line is electrically coupled to the primary electronics assembly, and each cable connector is removably positioned within one of the plurality of connector cavities and blind mate connected to the secondary electronics assembly. In one aspect, the housing comprises a mechanical float mechanism configured to facilitate movement of the right angle cable connector relative to the connector cavity and the housing body in multiple degrees of freedom.

FIGS. 1-5 illustrate various views of an electronics system 100 according to one example. The electronics system 100 can comprise a blind mate connector assembly 102 positioned between a primary electronics assembly 104 and a secondary electronics assembly 106 to facilitate a blind mate (mechanical and electrical) connection between the primary and secondary electronics assemblies 104 and 106.

Figure 4:
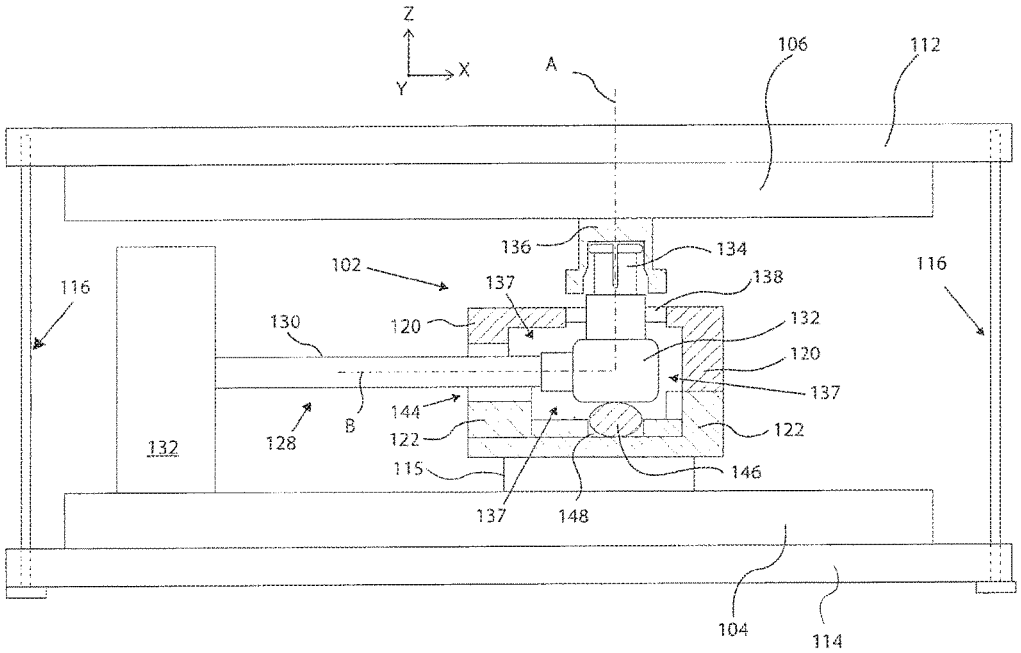
FIG. 4 is partial cross-sectional side view of the blind mate connector assembly of FIGS. 1-3 positioned between a pair of electronic assemblies according to one example of the present disclosure.

In one example, the primary and secondary electronics assemblies 104 and 106 can each be a circuit card assembly (CCA) having a plurality of electrical and mechanical components supported on a substrate. The primary electronics assembly 104 can have a first electrical coupling 108 that blind mate interfaces with a second electrical coupling 110 on the secondary electronics assembly 106. Such blind mate interface can be a power and control connection between blind mated CCAs, for instance. Advantageously, this connection can limit the amount of relative realignment required for another blind mate connection, such as for RF connections. In one aspect, a number of dielectric panels can be provided to mechanically couple (i.e., sandwich together) the primary and secondary electronics assemblies 104 and 106 together to form a low-profile electronics system. The panels can have fasteners that mechanically coupled the primary and secondary electronics 104 and 106 together via their substrates in a typical manner. When such panels and CCAs are sandwiched/attached together, for example, this can form a digital receiver module (DRM) used on Ku radio frequency systems (KRFS) as a part of an array back end unit (ABEU). As an example of this low-profile electronic assembly configuration, FIG. 4 shows the primary electronics assembly 104 generally parallel to secondary electronics assembly 106 and attached together between upper and lower panels 112 and 114, which can be attached to each other with fasteners 116, as known in the art. Other fasteners (not shown) can couple respective panels 112 and 114 to the primary and secondary electronics assemblies 104 and 106.

Accordingly, available space is limited between the primary and secondary electronic assemblies 104 and 106. Thus, the blind mate connector assembly 102 can be positioned between the primary and secondary electronics assembly 104 and 106 to facilitate a blind mate connection between the primary and secondary electronics assemblies 104 and 106.

In one example, the blind mate connector assembly 102 can comprise a first manifold 120 that is removably coupled to a second manifold 122 to collectively form a connector housing body, for instance. In one example shown in FIG. 1, a plurality of fasteners 124 (one labeled) are each positioned through respective apertures of the second manifold 122, as shown, and attached to receiving threads of the first manifold 120. These coupled first and second manifolds 120 and 122 can be removably attached to the first electronics assembly 104 using a pair of fasteners 126 (e.g., machine screws) disposed through apertures of the first electronics assembly 104. The fasteners 126 can be attached to receiving threads on either end of the first manifold 120. See also the partial cross sectional view FIG. 4 for the coupling interface between the first and second manifolds 120 and 122. In this example, the first and second manifolds 120 and 122 are mated to each other and attached to the primary electronics assembly 104.

A plurality of cables 128, each comprising a cable line 130 and a cable connector 132, can electrically couple the primary electronics assembly 104 to the secondary electronics assembly 106. For example, as shown in FIG. 4, a particular cable line 130 (e.g., coaxial cable) can be mechanically and electrically coupled to a multi-contact device 133, which can be a commercially available multi-contact RF module (or other backplane RF connector) attached to the primary electronics assembly 104. Such multi-contact device 133 can removably receive connector ends (not shown) of the cable lines 130, and therefore can electrically couple transmission of RF signals between the primary and secondary electronics assemblies 104 and 106, for example. It is noted that, in one example, the plurality of cables 128 can be commercially available as right angle coaxial cables that have connectors, such as SMPM connectors, SMP connectors, or similar connectors. However, this is not intended to be limiting in any way. Thus, as shown in FIG. 4, a blind mate connecting portion 134 of each cable connector 132 (e.g., a right angle connector) can be mechanically and electrically coupled to a blind mate receiving portion 136 of the secondary electronics assembly 106. This is discussed in more detail below.

In one example, at least one "mechanical float mechanism" can be provided by the configuration of the blind mate connector assembly 102 to facilitate movement of the cable connector 132 in multiple degrees of freedom relative to the first and second manifolds 120 and 122 (and consequently relative to the assemblies 104 and 106). More specifically, and as illustrated in FIG. 4, when the first and second manifolds 120 and 122 are coupled together, a plurality of connector cavities 137 can be formed to retain each respective cable connector 132. As shown, the perimeter walls of the connector cavity 137 (defined by recesses/cavities in each of the first and second manifolds 120 and 122) can be formed to be spatially separated away from the cable connector 132, meaning that the connector cavity 137 is sized larger than the cable connector 132, such that it "loosely" retains the cable connector 132 to allow relative movement of the cable connector 132 within its particular connector cavity 137. This is one example of a "mechanical float mechanism" that facilitates some movement of the cable connector 132 while the secondary electronics assembly 106 is being blind mate connected to the primary secondary electronics assembly 104. This can account for tolerances that can cause misalignment between the primary and secondary electronic assemblies 104 and 106 when being blind mate coupled together. That is, each of the plurality of cable connectors 132 can be configured and permitted to move a certain degree within the respective connector cavity 137 so that each and every cable connector 132 (e.g., 8 total in this example) can be simultaneously blind mate connected to respective blind mate receiving portions 136 along the secondary electronics assembly 106. Such blind mate interface (e.g., of 134 and 136) is known in the art and will not be discussed in detail, but it will be appreciated that such interface can comprise a press-fit or friction-fit interface that can be achieved with between one and five pounds of force, for instance.

Figure 5:
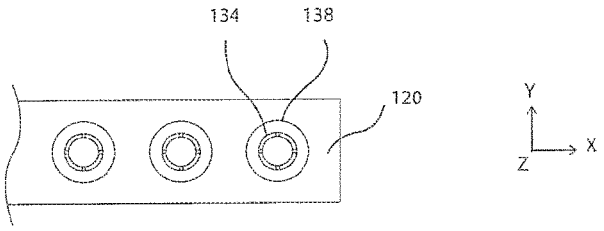
FIG. 5 is partial top view of a right portion of the blind mate connector assembly of FIG. 2 according to one example of the present disclosure.

In another example of a "mechanical float mechanism", the cable connector 132 can be allowed to move in the x and/or y directions relative to the first and second manifolds 120 and 122. This can also account for misalignment between the primary and secondary assemblies 104 and 106 when being blind mate connected to each other. More specifically, the first manifold 120 can comprises a plurality of first openings 138 (e.g., 8 shown on FIG. 1), each having a central axis A along the z axis, which is best shown in FIG. 4. Each first opening 138 can be sized larger than the blind mate receiving portion 134 of the cable connector 132, such that the blind mate receiving portion 134 can be spatially separated from the edges defined by the first opening 138 so that the cable connector 132 can freely move about the first opening 138. This is also illustrated by the top-down view of FIG. 5, showing three blind mate connecting portions 134 loosely received by respective first openings 138 of the first manifold 120. This configuration allows the cable connector 132 to move (axially and/or radially) about the first opening 138 when the blind mate receiving portion 136 (of the second electronic assembly 106) locates and receives the blind mate connecting portion 134 during blind mate coupling. This can also account for misalignment between the primary and secondary assemblies 104 and 106, which is typically caused by tolerance issues between coupled/fastened components of a low-profile electronics system, for instance. Each first opening 138 having these "oversized holes" also works in conjunction with the connector cavities 137 loosely receiving each cable connector 132 to allow multiple degrees of movement of the cable connectors 132 within their respective connector cavities 137.

In another example of a mechanical float mechanism, the cable line 130 (e.g., a coaxial cable line) can be allowed to move relative to the first and second manifolds 120 and 122 to account for misalignment (e.g., radial) between the primary and secondary electronics assemblies 104 and 106 when blind mate coupled to each other. More specifically, the first manifold 120 can comprise a plurality of recesses 140 formed along a lower edge of the first manifold 120 and that can be in fluid or volumetric communication with the respective connector cavity 137 (see FIGS. 1, 2, and 4). Similarly, the second manifold 122 can comprise a plurality of recesses 142 formed along an upper edge of the second manifold 122 at locations corresponding to the recesses 140 of the first manifold 120. Collectively, each recess 140 and each (corresponding) recess 142 can form a second opening 144 through which a particular cable line 30 can pass or extend. See FIG. 4 specifically for an example arrangement of the cable line 30 extending loosely through the second opening 144. Thus, the mechanical float mechanism in this example can be defined by the second opening 144 being sized larger than the cable line 130 so that the second opening 144 loosely retains a portion of the cable line 130. This can facilitate movement of the cable line 130 about the second opening 144 to account for misalignment between the primary and secondary assemblies 104 and 106 because, as they are mated to each other, the cable connectors 132 may move within their respective cavity 137, which can cause the cable lines 130 to move. If the cable lines 30 were tightly received (e.g., pinched) between the first and second manifolds 120 and 122, damage to the cable connectors 132 would likely occur during repeated coupling of the assemblies 104 and 106 to and from each other.

As can be appreciated on FIG. 4, the central axis A of the first opening 138 can be transverse (e.g., in some examples orthogonal or perpendicular) to a central axis B of the second opening 144. Such configuration assists to properly retain and appropriately position the cable 128 between the first and second manifolds 120 and 122 so that the blind mate connecting portions 134 can extend through respective first openings 138 as the cable lines 130 extend through respective second openings 144.

Figure 3:
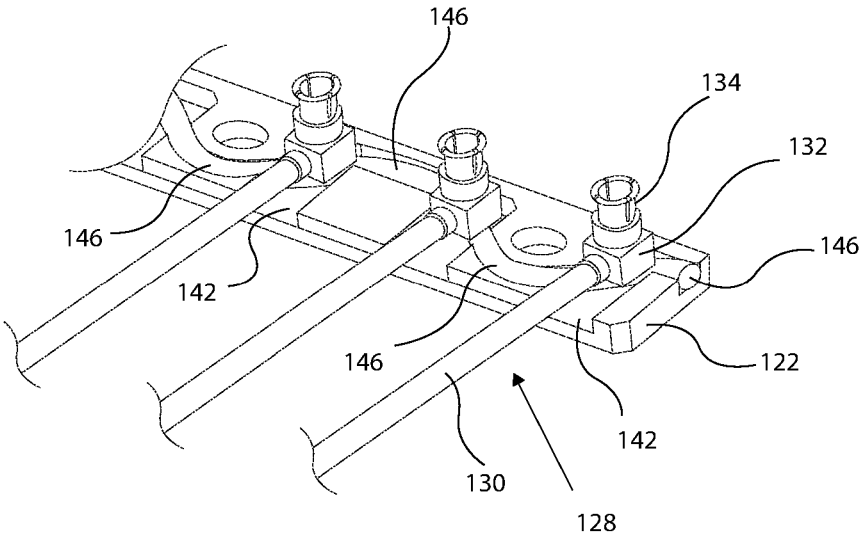
FIG. 3 is a partial isometric view of the lower manifold and the cable line and cable connector components of the blind mate connector assembly of FIG. 1.

In yet another example of a mechanical float mechanism, a spring 146 (or other biasing device) can be situated within the connector cavity 137 and configured to bias each cable connector 132 in a z direction (as shown in the drawings) along the respective central axis A of the first opening 138 toward the secondary electronics assembly 106. In one aspect, the spring 146 can be one or more compliant dielectric/EMI strips, or the spring can be individual leaf springs or compression springs or O-rings positioned below each of the cable connectors 132. In one example shown in FIGS. 1, 3, and 4, each spring 146 (being illustrated as a pair of compliant strips) can each be retained within and along a respective groove 148 formed in the second manifold 122. The grooves 148 can interconnect the plurality of cavities 137, as shown in FIG. 3. The grooves 148 can be formed laterally along a length of the second manifold 122 in a manner that positions a portion of each spring 146 directly below a corresponding cable connector 132, and along the central axis A of each first opening 138 (see FIG. 4).

Accordingly, when the blind mate receiving portion 136 of the second electronics assembly 106 is caused to move vertically downward (e.g., in the z direction) toward the blind mate connecting portion 134, the spring 146 can be slightly compressed, which causes an upward biasing force (in the z direction) to assist with completing the blind mate (friction-fit) interface between the blind mate receiving portion 136 and the blind mate connecting portion 134. Thus, all of the cable connectors 132 can be simultaneously blind mated to respective blind mate receiving portions 136 of the secondary electronics assembly 106. The spring 146 can also allow for some amount of rotational movement of the cable connector 132 so that it may freely move in the x and/or y directions (laterally and/or radially) about the first opening 138 until the cable connector 132 is blind mated into its respective blind mate receiving portion 136.

As can be appreciated from the example configuration shown in FIG. 1, if one or more cables 128 are damaged or otherwise need replaced/upgraded, the first and second manifolds 120 and 122 can be removed from the primary electronics assembly 104 by removing fasteners 126 (after the secondary electronics assembly 106 is detached from the primary electronics assembly 104). Once the first and second manifolds 120 and 122 are collectively removed, the second manifold 122 can be detached from the first manifold 120 by removing fasteners 124, which then exposes the cable connectors 132 of the cables 128. Then, one or more cables 128 can be removed and replaced, and then the first and second manifolds 120 and 122 can be reattached to each other and then reattached to the primary electronics assembly 104.

As shown in FIGS. 1 and 4, the first manifold 120 can have downwardly formed protrusions 115 on either end that are biased to the first electronics assembly 104 when attached thereto. This configuration positions the second manifold 122 above and away from the first electronics assembly 104 to avoid any unwanted electrical contact to the primary electronics assembly 104 with the fasteners 124 and/or cable lines 130. The first and second manifolds 120 and 122 can be comprised of a rigid dielectric material, such as polymer or plastic.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

As disclosed herein, various embodiments and examples may be referred to herein along with alternatives for the various components thereof. It is understood that such embodiments, examples, and alternatives are not to be construed as de facto equivalents of one another.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A cable connector housing for blind mate connection of a right angle cable connector to an electronics assembly, the cable connector housing comprising:

a housing body;

a connector cavity formed within the housing body and configured to receive and retain a right angle cable connector;

a first opening formed through the housing body to the connector cavity, the first opening having a central axis and being sized to receive a blind mate connecting portion of the right angle cable connector;

a second opening formed through the housing body to the connector cavity, the second opening having a central axis and being sized to receive a cable line connected to the right angle cable connector, wherein the central axes of the first and second openings are oriented transverse to one another; and a mechanical float mechanism comprising the connector cavity being sized larger than the right angle cable connector to facilitate movement of the right angle cable connector relative to the housing body in at least four degrees of freedom.

2. The cable connector housing of claim 1, wherein the mechanical float mechanism further comprises a spring in the form of an elongate elastomeric spring situated in the connector cavity and operable to bias the right angle cable connector, and to facilitate movement of the right angle cable connector in at least two degrees of freedom.

3. The cable connector housing of claim 1, wherein the mechanical float mechanism further comprises at least one of:

the first opening being sized larger than a blind mate connecting portion of the right angle cable connector to facilitate movement of the blind mate connecting portion in a z direction and at least one of an x direction and a y direction relative to the housing; and the second opening being sized larger than the cable line to facilitate movement of the cable line within the second opening.

4. The cable connector housing of claim 1, wherein the mechanical float mechanism further comprises a spring situated within the connector cavity, and configured to bias the right angle cable connector in a z direction along the central axis of the first opening and toward the electronics assembly.

5. The cable connector housing of claim 1, wherein the housing body comprises a first manifold and a second manifold removably coupled to each other, wherein the connector cavity is disposed between the first and second manifolds, wherein the first and second manifolds define a plurality of connector cavities each configured to receive a right angle cable connector, the first manifold comprising a plurality of first openings each being sized larger than a blind mate connecting portion of a plurality of respective right angle cable connectors to facilitate movement of the blind mate connecting portions, and the first and second manifolds defining a plurality of second openings being sized larger than a cable line of the respective right angle cable connectors to facilitate movement of the respective cable lines about the second opening.

6. A blind mate connector assembly, comprising:

a first manifold comprising a plurality of first openings each having a central axis;

a second manifold removably coupled to the first manifold to define a connector housing positionable between a primary electronics assembly and a secondary electronics assembly, the second manifold comprising a plurality of second openings each having a central axis;

a plurality of connector cavities defined by the first and second manifolds; and a plurality of right angle cable connectors, each situated within one of the plurality of connector cavities, the right angle cable connectors facilitating blind mate connection between the primary electronics assembly and the secondary electronics assembly, wherein the first and second manifolds are removably coupled to each other such that removal of the first manifold from the second manifold exposes the plurality of right angle cable connectors for removal from respective connector cavities, and wherein each connector cavity is sized larger than a respective one of the right angle cable connectors to facilitate movement of the one right angle cable connector in at least four degrees of freedom.

7. The blind mate connector assembly of claim 6, further comprising a mechanical float mechanism comprising at least one of:

the plurality of connector cavities being sized larger than the right angle cable connector situated therein, such that the right angle cable connectors are loosely situated in respective connector cavities;

the plurality of first openings each being sized larger than a blind mate connecting portion of the right angle cable connector to facilitate movement of the blind mate connecting portion in a z direction and at least one of an x direction and a y direction relative to the connector housing;

the plurality of second openings each being sized larger than a cable line to facilitate movement of the cable line within the corresponding second opening.

8. The blind mate connector assembly of claim 6, wherein the mechanical float mechanism further comprises a plurality of springs situated within each of the plurality of connector cavities, and configured to bias the plurality of right angle cable connectors in a z direction along the central axis of the corresponding plurality of first openings.

9. The blind mate connector assembly of claim 6, wherein the second manifold comprises a groove interconnecting the plurality of connector cavities, and wherein the mechanical float mechanism further comprises a spring in the form of an elongate elastomeric spring disposed within the groove, and extending through the plurality of connector cavities to bias the plurality of right angle cable connectors in a z direction along the central axis of the first openings.

10. The blind mate connector assembly of claim 6, wherein each of the plurality of second openings are defined by respective recesses in each of the first and second manifolds, whereby the respective recesses are aligned to facilitate passage of a cable line attached to the right angle cable connector.

11. The blind mate cable connector of claim 6, wherein the respective central axes of the plurality of first and second openings are orthogonal to one another, such that the plurality of first openings are oriented orthogonal to the plurality of second openings.

12. An electronics system comprising:

a primary electronics assembly;

a secondary electronics assembly mechanically and electrically coupled to the primary electronics assembly;

a blind mate connector assembly coupled between the primary electronics assembly and the secondary electronics assembly, the blind mate connector assembly comprising:

a housing removably attached to the primary electronics assembly, the housing having first and second manifolds that define a plurality of connector cavities; and a plurality of cables each comprising a cable connector and a cable line extending from the cable connector, wherein each cable line extends through a respective first aperture defined by the first and second manifolds, and each cable line is electrically coupled to the primary electronics assembly, and wherein each cable connector removably positioned within one of the plurality of connector cavities and blind mate connected to the secondary electronics assembly via a blind mate connecting portion of the cable connector extends through a respective second aperture of the first manifold, wherein each connector cavity is sized larger than the cable connector to facilitate movement of the cable connector, and of the respective cable line and the respective blind mate connecting portion, relative to the housing in multiple degrees of freedom.

13. The system of claim 12, wherein the cable connector is a right angle cable connector.

14. The system of claim 13, wherein the first manifold and the second manifold are removably attached to each other to facilitate removal and replacement of the cable connectors.

15. The system of claim 14, further comprising a mechanical float mechanism comprising at least one of:

the plurality of connector cavities being sized larger than the right angle cable connector situated therein, such that the right angle cable connectors loosely fit within respective connector cavities; and the first apertures being sized larger than the blind mate connecting portions of the corresponding right angle cable connectors to facilitate movement of the blind mate connecting portions in a z direction and in at least one of an x direction and a y direction relative to the housing.

16. The system of claim 15, wherein the mechanical float mechanism comprises the second apertures being sized larger than the corresponding cable lines to facilitate movement of the cable lines within the second apertures and to allow for radial misalignment between the primary and secondary electronics assemblies.

17. The system of claim 15, wherein the mechanical float mechanism comprises a spring situated within each connector cavity, and configured to bias each right angle cable connector in a z direction along a central axis of the first opening and toward the secondary electronics assembly.

18. The system of claim 16, wherein each of the second apertures are defined by respective recesses in each of the first and second manifolds, whereby the respective recesses are aligned to facilitate passage of corresponding cable lines.

19. The system of claim 16, wherein respective central axes of the first and second apertures are orthogonal to one another, such that the first apertures are oriented orthogonal to the second apertures.

20. The system of claim 18, wherein the plurality of cables are radio frequency connector cables.

21. The blind mate connector assembly of claim 6, wherein the mechanical float mechanism further comprises a spring supported by the second manifold, and configured to bias the at least two right angle cable connectors in a z direction along the central axis of the corresponding plurality of first openings.

* * * * *